US005831139A

United States Patent [19]

Schmidt et al.

[11] Patent Number: 5,831,139

[45] Date of Patent: Nov. 3, 1998

[54] PRODUCTION OF ALIPHATIC GASOLINE

[75] Inventors: Robert J. Schmidt, Barrington; Paula L. Bogdan, Mount Prospect; Leonid B. Galperin, Wilmette; Jennifer S. Holmgren, Bloomingdale, all of Ill.

[73] Assignee: UOP LLC, Des Plaines, Ill.

[21] Appl. No.: 832,321

[22] Filed: Mar. 26, 1997

Related U.S. Application Data

[63] Continuation of Ser. No. 473,381, Jun. 7, 1995, abandoned.

[51] Int. Cl.[6] ..... C07C 1/00; C07C 5/13

[52] U.S. Cl. ..... 585/315; 585/310; 585/737; 585/739; 585/940

[58] Field of Search ..... 585/310, 315, 585/253, 266, 269, 737, 739, 750, 940

[56] References Cited

U.S. PATENT DOCUMENTS

| | | | |
|---|---|---|---|
| 3,788,975 | 1/1974 | Donaldson | 208/60 |
| 5,334,792 | 8/1994 | Del Rossi et al. | 585/314 |
| 5,463,155 | 10/1995 | Galperin et al. | 585/310 |
| 5,498,810 | 3/1996 | Bogdan et al. | 585/310 |

OTHER PUBLICATIONS

Copending application Ser. No. 08/151,692 (Galperin et al) filed Nov. 15, 1993.

*Primary Examiner*—Glenn Caldarola
*Assistant Examiner*—Thuan D. Dang
*Attorney, Agent, or Firm*—Thomas K. McBride; John F. Spears, Jr.; Richard E. Conser

[57] ABSTRACT

A process combination is disclosed to selectively upgrade naphtha in accordance with expected trends leading to more-aliphatic gasolines. Such gasolines contain lower concentrations of aromatics and have lower end points with concomitant reduced harmful automotive emissions. The present process combination converts the higher-boiling portion of the naphtha, yields isobutane and other isoparaffins which are particularly suitable for upgrading or blending, and reduces cyclics in intermediate processing steps.

15 Claims, 4 Drawing Sheets

PRODUCTION OF ALIPHATIC GASOLINE

This is a continuation of patent application Ser. No. 08/473,381 filed on Jun. 7, 1995, now abandoned.

BACKGROUND OF THE INVENTION

1. Field of the Invention

This invention relates to an improved process combination for the conversion of hydrocarbons, and more specifically for the selective upgrading of naphtha to lighter intermediates for production of gasoline.

2. General Background

The widespread removal of lead antiknock additive and subsequent reformulation of gasoline and the continuing fuel-quality demands of high-performance internal-combustion engines have compelled petroleum refiners to install new and modified processes for increased "octane," or knock resistance, in the gasoline pool. Refiners have relied on a variety of options to upgrade the gasoline pool, including higher-severity catalytic reforming, higher FCC (fluid catalytic cracking) gasoline octane, isomerization of light naphtha and the use of oxygenated compounds. Such key options as increased reforming severity and higher FCC gasoline octane result in a higher aromatics content of the gasoline pool, through the production of high-octane aromatics at the expense of low-octane heavy paraffins. Current gasolines generally have aromatics contents of about 30% or more, with many being substantially higher.

Currently, refiners are faced with the prospect of supplying reformulated gasoline to meet tightened automotive emission standards. Reformulated gasoline would differ from the existing product in having a lower vapor pressure, lower final boiling point, increased content of oxygenates, and lower content of olefins, benzene and aromatics. The oxygen content of gasoline will be 2% or more in many areas. Gasoline aromatics content may eventually be lowered into the 20–25% range in major urban areas, and low-emission gasoline containing less than 15% aromatics is being advocated for some areas with severe pollution problems. Distillation end-point specifications also could be lowered; end point often is characterized as the 90% distillation temperature, currently limited to a maximum of 190° C. and averaging 165°–170° C., which could be reduced to around 150° C. in some cases.

Aliphatic-rich gasolines are considered to be costly and difficult to produce; aromatics have been the principal source of increased gasoline octanes during the recent lead-reduction program, and severe restriction of the aromatics content and high-boiling portion will present refiners with processing problems. Currently applicable technology includes such processes as recycle isomerization of light naphtha, increased yields of light olefins from fluid catalytic cracking and isobutane production by isomerization as feedstock to an alkylation unit. Increased blending of oxygenates such as methyl tertiary-butyl ether (MTBE) and ethanol will be an essential part of the reformulated-gasoline program, but feedstock supplies will become stretched. Novel processing technology is needed to support effective adaptation to aliphatic gasolines.

Numerous process combinations for the upgrading of naphtha to yield gasoline have been disclosed. These combine known and novel processing steps primarily to increase gasoline octane, and generally include one or both of reforming to obtain aromatics and isomerization to increase paraffin branching. Such combinations are in contrast to the present scheme, which is directed to reduced cyclics and yields isoparaffins which would not benefit from isomerization.

U.S. Pat. No. 3,788,975 (Donaldson) teaches a combination process for the production of aromatics and isobutane using "I-cracking" followed by a combination of processes including catalytic reforming, aromatic separation, alkylation, isomerization, and dehydrogenation to yield alkylation feedstock. The paraffinic stream from aromatic extraction is returned to the cracking step. Donaldson does not disclose the present process combination, however, and would not realize the present gasoline selectivity from the selective-isoparaffin-synthesis/reforming combination. Copending application Ser. No. 08/151,692 discloses a combination of ring cleavage and isomerization of light paraffins, using a nonacidic ring-cleavage catalyst.

SUMMARY OF THE INVENTION

It is an object of the present invention to provide an improved process combination to upgrade naphtha to lighter intermediates for reformulated gasoline. A specific object is to selectively convert naphtha to isoparaffins and aliphatic intermediates which are particularly suited for production of high-octane gasoline having a reduced aromatics content and distillation end point.

This invention is based on the discovery that a process combination based on processing of selected naphtha fractions by selective isoparaffin synthesis and selective ring opening can yield $C_4$+ paraffinic products having high isoparaffin contents with high selectivity and low production of light gases.

A broad embodiment of the present invention is directed to a process combination comprising selective isoparaffin synthesis from heavy naphtha to yield a product comprising isobutane and synthesis naphtha with reduced end point, separation of light products from heavy synthesis naphtha, and conversion of the heavy synthesis naphtha by selective ring cleavage to provide additional feed to the selective isoparaffin synthesis. The products of selective isoparaffin synthesis comprise isobutane and isopentane generally in higher ratios than can be achieved by isomerization. In a preferred embodiment, heavy synthesis naphtha is converted using a nonacidic ring-cleavage catalyst comprising a nonacidic inorganic oxide, a metal oxide solid solution or a large-pore molecular sieve. The selective-isoparaffin-synthesis catalyst preferably comprises a zeolite. Optimally, the ring-cleavage zone and selective-isoparaffin-synthesis zone are integrated into a single hydrogen circuit.

Optionally, the heavy-naphtha feedstock comprises gasoline from fluid catalytic cracking. A feedstock hydrogenation zone preferably precedes the selective-isoparaffin-synthesis zone especially when the feedstock comprises catalytically cracked gasoline.

These as well as other objects and embodiments will become apparent from the detailed description of the invention.

DESCRIPTION OF THE PREFERRED EMBODIMENTS

Figure 1:
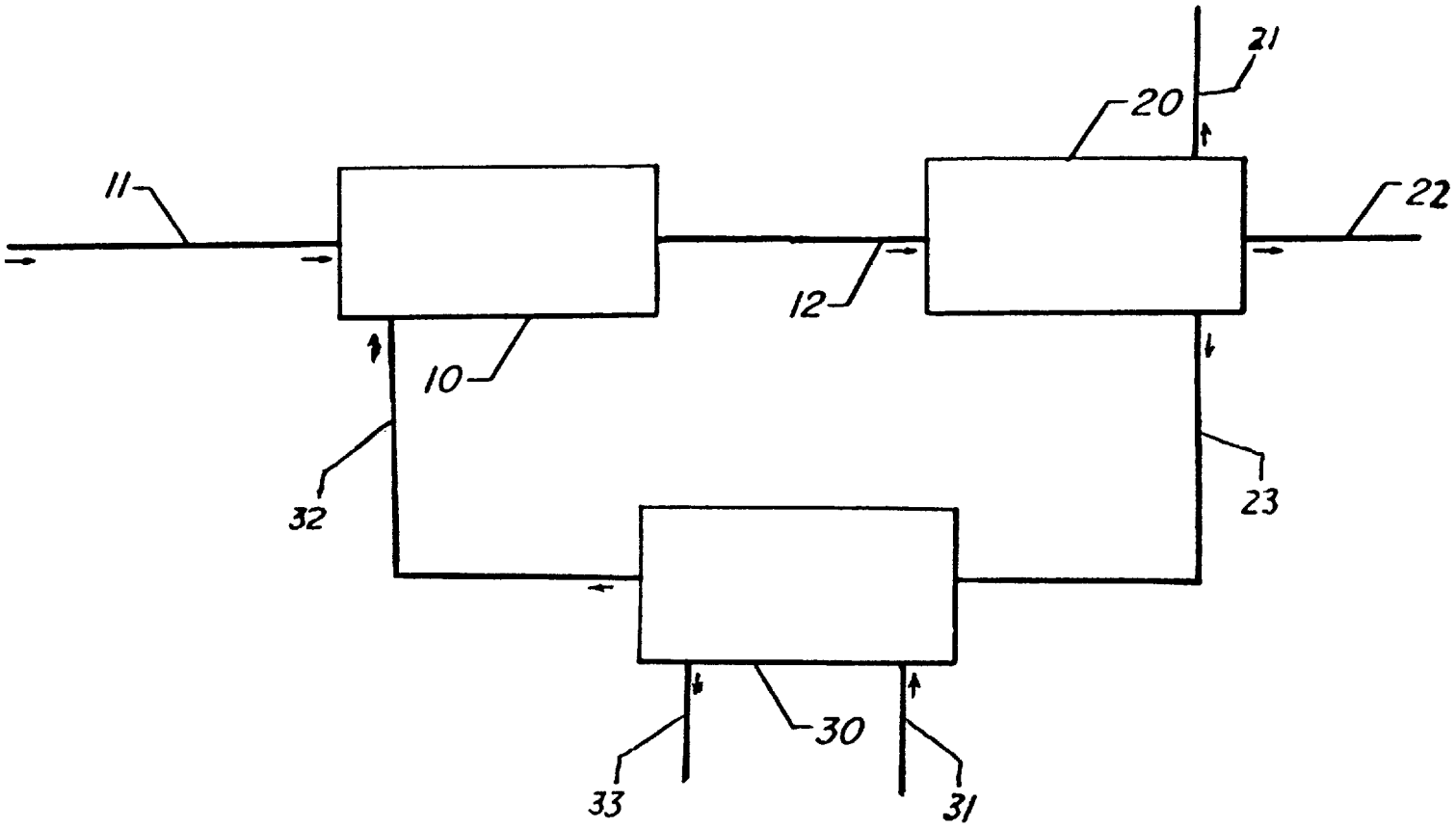
FIG. 1 represents a simplified block flow diagram showing the arrangement of the major sections of the present invention.

A broad embodiment of the present invention therefore comprises selective isoparaffin synthesis from heavy naphtha to yield a product comprising isobutane, isopentane and a recycle stream which is subjected to ring cleavage in order to increase the overall selectivity of the process combination. Usually the process combination is integrated into a petroleum refinery comprising crude-oil distillation, reforming, cracking and other processes known in the art to produce finished gasoline and other petroleum products.

The naphtha feedstock to the present process combination comprises paraffins and naphthenes, and may comprise aromatics and small amounts of olefins, boiling within the gasoline range. Feedstocks which may be utilized include straight-run naphthas, natural gasoline, synthetic naphthas, thermal gasoline, catalytically cracked gasoline, partially reformed naphthas or raffinates from extraction of aromatics. The distillation range generally is within that of a full-range naphtha, having an initial boiling point typically from 0° to 100° C. and a final boiling point of from about 160° to 230° C. More usually, the feedstock is a heavy or high-boiling naphtha having an initial boiling point of from about 60° to 150° C., especially from about 80° to 140° C., and a final boiling point from about 175° to 200° C. In any event, the naphtha feedstock generally contains a substantial concentration of $C_9$–$C_{10}$ hydrocarbons; if the feedstock were to be processed directly in a conventional catalytic reforming unit, the product reformate would be high in aromatics and contain excessive high-boiling compounds for blending into current well-publicized "reformulated gasolines" which have been specified to reduce automotive emissions.

The presence of high-boiling compounds is characterized by the end point, or final boiling point, and/or 90% distillation point as measured by the standard ASTM D-86 distillation test. End points of reformates are significantly higher than those of the reformer feeds from which they are derived. The present process combination enables processing of a naphtha feedstock containing higher-boiling compounds than otherwise would be possible, according to processes of the prior art, with high gasoline yields while meeting reformulated-gasoline specifications. The high-boiling portion of the naphtha feedstock is converted in the selective-isoparaffin-synthesis step to obtain a lower-boiling selective-isoparaffin-synthesis product which can be blended into gasoline or processed by reforming or other further processing, thereby converting a greater proportion of naphtha into gasoline than if a narrower-range feedstock were processed by catalytic reforming without selective isoparaffin synthesis.

The naphtha feedstock generally contains small amounts of sulfur compounds amounting to less than 10 parts per million (ppm) on an elemental basis. Preferably the naphtha feedstock has been prepared from a contaminated feedstock by a conventional pretreating step such as hydrotreating, hydrorefining or hydrodesulfurization to convert such contaminants as sulfurous, nitrogenous and oxygenated compounds to $H_2S$, $NH_3$ and $H_2O$, respectively, which can be separated from hydrocarbons by fractionation. This conversion preferably will employ a catalyst known to the art comprising an inorganic oxide support and metals selected from Groups VIB(6) and VIII(9–10) of the Periodic Table. [See Cotton and Wilkinson, *Advanced Inorganic Chemistry,* John Wiley & Sons (Fifth Edition, 1988)]. Preferably, the pretreating step will provide the selective-isoparaffin-synthesis step with a hydrocarbon feedstock having low sulfur levels disclosed in the prior art as desirable, e.g., 1 ppm to 0.1 ppm (100 ppb). It is within the ambit of the present invention that this optional pretreating step be included in the present process combination.

Optionally, the heavy naphtha feedstock with or without pretreating is processed in a hydrogenation zone which effects saturation of aromatics at hydrogenation conditions over a hydrogenation catalyst to produce a saturated intermediate. The hydrogenation zone contains a catalyst which preferably comprises one or more of nickel and the platinum-group metals, selected from the group consisting of platinum, palladium, ruthenium, rhodium, osmium, and iridium, on a suitable refractory inorganic-oxide support. The inorganic-oxide support preferably comprises alumina, optimally an anhydrous gamma-alumina with a high degree of purity. Spent selective isoparaffin-synthesis catalyst may be used for hydrogenation after deactivation renders it unsuitable for the synthesis operation. Hydrogenation conditions include pressures from about 1 to 10 MPa gauge, preferably between about 2 and 7 MPa, temperatures as low as 30° C. but preferably in the range of 90° to 120° C., hydrogen to hydrocarbon ratios of about 0.1 to 10, preferably between about 1 and 5, and liquid hourly space velocities (LHSV) ranging from about 1 to 8. The saturated intermediate optionally may be transferred to a selective-isoparaffin-synthesis zone which preferably is contained within the same hydrogen circuit, i.e., hydrogen and light hydrocarbons are not separated from the saturated intermediate before the selective-isoparaffin-synthesis zone. Further details of the optional hydrogenation zone are disclosed in U.S. Pat. No. 5,235,120, incorporated herein by reference.

FIG. 1 provides an overview of the basic process combination. The block flow diagram does not detail but assumes the presence of such appurtenances as heat exchangers, pumps, compressors and instruments known to those of ordinary skill in the art. As illustrated in this simplified diagram, the naphtha feedstock is introduced into selective-isoparaffin-synthesis zone 10 via line 11. This zone contains an active, selective isoparaffin-synthesis catalyst which permits operation at pressures and temperatures which are significantly below those employed in conventional hydrocracking. Heavier components of the naphtha are converted in the presence of hydrogen with minimal formation of light hydrocarbons such as methane, ethane and propane. Side chains are cracked from heavier cyclic compounds while retaining naphthenic rings. Heavy paraffins are converted to yield a high proportion of isobutane, useful for production of alkylate or ethers for gasoline blending. Lighter paraffins such as pentanes and hexanes are formed in the process with a high proportion of higher-octane branched-chain isomers, and the isopentane/normal-pentane ratio is in excess of that which usually would be obtained by pentane isomerization. The overall effect is that the molecular weight and final boiling point of the hydrocarbons are reduced, the concentration of cyclics is retained, and the content of isoparaffins is increased significantly in synthesis effluent relative to the naphtha feedstock. A synthesis effluent leaves the selective-isoparaffin-synthesis zone 10 via line 12.

The synthesis effluent passes to a separation zone 20 which yields an isobutane concentrate in line 21, a light synthesis naphtha containing pentanes in line 22, and a heavy synthesis naphtha in line 23. The isobutane/n-butane ratio in the concentrate and the isopentane/n-pentane ratio in the light synthesis naphtha generally are higher than equilibrium, i.e., higher than those which would be obtained by isomerization at usual butanelpentane isomerization temperatures or synthesis temperatures of the present combination.

The heavy synthesis naphtha passes to the ring-cleavage zone 30, preferably along with hydrogen via line 31. The synthesis naphtha contacts a ring-cleavage catalyst at ring-cleavage conditions to open naphthenic rings and produces a paraffinic intermediate in line 32. Light gases produced in the ring-cleavage zone may either be removed via line 33 if the ring-cleavage and selective-isoparaffin-synthesis zones have separate hydrogen circuits or passed into the synthesis zone in combination with the paraffinic intermediate if the two zones are contained in a single hydrogen circuit.

Selective-isoparaffin-synthesis operating conditions vary according to the characteristics of the feedstock and the product objectives. Operating pressure may range between about 1 MPa and 10 MPa gauge, and preferably between about 2 and 7 MPa. Temperature is selected to balance conversion, which is promoted by higher temperatures, against selectivity and favorable isomerization equilibrium which are favored by lower temperatures; operating temperature generally is between about 50° and 450° C., more usually between about 50° and 350° C. and preferably between about 100° and 300° C. Catalyst is loaded into the reactors of the selective-isoparaffin-synthesis process to provide a liquid hourly space velocity of between about 0.5 and 20, and more usually between about 1.0 and 10. The operating conditions generally will be sufficient to effect a yield of at least 8 volume % butanes, and preferably about 15 volume % or more, from the selective-isoparaffin-synthesis zone relative to the heavy naphtha fraction fed to the zone.

Hydrogen is supplied to the reactors of the selective isoparaffin-synthesis process not only to provide for hydrogen consumed in cracking, saturation and other reactions but also to maintain catalyst stability. The hydrogen may be partially or totally supplied from outside the process, and a substantial proportion of the requirement may be provided by hydrogen recycled after separation from the reactor effluent. The molar ratio of hydrogen to naphtha feedstock ranges usually from about 0.1 to 10. In an alternative embodiment, the hydrogen-to-hydrocarbon mole ratio in the reactor effluent is about 0.05 or less; this deviates the need to recycle hydrogen from the reactor effluent to the feed.

The selective-isoparaffin-synthesis zone contains a solid acid selective isoparaffin-synthesis catalyst. The acid component may be, for example, a halide, such as aluminum chloride; a zeolite, such as mordenite; a mineral acid such as $H_2SO_4$ or a solid strong acid such as sulfate incorporated into a support such as zirconia (U.S. Pat. No. 5,036,035). Suitable zeolites, in addition to MOR, include FAU, LTL, MAZ, MEL, MFI, and MTW (IUPAC Commission on Zeolite Nomenclature) and Beta; such zeolites are known in the art, e.g., U.S. Pat. Nos. 4,083,886 and 4,826,801 (MOR), U.S. Pat. Nos. 3,130,007 and 4,401,556 (FAU), U.S. Pat. Nos. 3,216,789 and 4,503,023 (LTL), U.S. Pat. Nos. 4,241,036 and 5,192,727 (MAZ), U.S. Pat. No. 3,709,979 (MEL), U.S. Pat. No. 3,702,886 (MFI), U.S. Pat. No. 3,832,449 (MTW), and U.S. Pat. Nos. 3,308,069/Re 28,341 and 5,095,169 (Beta), all of which are incorporated herein by reference. In addition to MOR, FAU, MAZ and Beta are preferred.

Generally the catalyst will contain a refractory inorganic oxide as described hereinbelow, with alumina or zirconia being particularly preferred. The selective isoparaffin-synthesis catalyst is effective in producing a superequilibrium concentration of isobutane in butanes produced in the selective-isoparaffin-synthesis zone at selective-isoparaffin-synthesis conditions.

The selective isoparaffin-synthesis catalyst preferably comprises an inorganic-oxide support, an acid component and a Group VIII (8–10) metal component. The refractory inorganic-oxide support optimally is a porous, adsorptive, high-surface-area support having a surface area of about 25 to about 500 $m^2/g$. The porous carrier material should also be uniform in composition and relatively refractory to the conditions utilized in the process. By the term "uniform in composition," it is meant that the support be unlayered, has no concentration gradients of the species inherent to its composition, and is completely homogeneous in composition. Thus, if the support is a mixture of two or more refractory materials, the relative amounts of these materials will be constant and uniform throughout the entire support. It is intended to include within the scope of the present invention refractory inorganic oxides such as alumina, titania, zirconia, chromia, zinc oxide, magnesia, thoria, boria, silica-alumina, silica-magnesia, chromia-alumina, alumina-boria, silica-zirconia and other mixtures thereof. The selective isoparaffin-synthesis catalyst optionally also may contain one or more of the crystalline zeolitic aluminosilicates and non-zeolitic molecular sieves described hereinabove.

The preferred refractory inorganic oxide will have an apparent bulk density of about 0.3 to about 1.01 g/cc and surface area characteristics such that the average pore diameter is about 20 to 300 angstroms, the pore volume is about 0.05 to about 1 cc/g, and the surface area is about 50 to about 500 $m^2/g$. The preferred refractory inorganic oxide for use in the present invention is alumina. Suitable alumina materials are the crystalline aluminas known as the gamma- , eta- , and theta-alumina, with gamma- or eta-alumina giving best results. "Ziegler alumina" as described above in connection with the reforming catalyst is especially preferred.

The alumina powder may be formed into a suitable catalyst material according to any of the techniques known to those skilled in the catalyst-carrier-forming art. Spherical carrier particles may be formed, for example, from this Ziegler alumina by (1) converting the alumina powder into an alumina sol by reaction with a suitable peptizing acid and water and thereafter dropping a mixture of the resulting sol and a gelling agent into an oil bath to form spherical particles of an alumina gel which are easily converted to a gamma-alumina carrier material by known methods; (2) forming an extrudate from the powder by established methods and thereafter rolling the extrudate particles on a spinning disk until spherical particles are formed which can then be dried and calined to form the desired particles of spherical carrier material; and (3) wetting the powder with a suitable peptizing agent and thereafter rolling the particles of the powder into spherical masses of the desired size. This alumina powder can also be formed in any other desired shape or type of carrier material known to those skilled in the art such as rods, pills, pellets, tablets, granules, extrudates, and like forms by methods well known to the practitioners of the catalyst material forming art.

The preferred form of carrier material for the selective isoparaffin-synthesis catalyst is a cylindrical extrudate. Extrudate particles optimally are prepared by mixing the alumina powder with water and suitable peptizing agents such as nitric acid, acetic acid, aluminum nitrate, and the like material until an extrudable dough is formed. The amount of water added to form the dough is typically sufficient to give a Loss on Ignition (LOI) at 500° C. of about 45 to 65 mass %, with a value of 55 mass % being especially preferred. The resulting dough is then extruded through a suitably sized die to form extrudate particles.

The extrudate particles are dried at a temperature of about 150° to about 200° C., and then calcined at a temperature of about 450° to 800° C. for a period of 0.5 to 10 hours to effect the preferred form of the refractory inorganic oxide. It is preferred that the refractory inorganic oxide comprise substantially pure gamma alumina having an apparent bulk density of about 0.6 to about 1 g/cc and a surface area of about 150 to 280 $m^2/g$ (preferably 185 to 235 $m^2/g$, at a pore volume of 0.3 to 0.8 cc/g).

An essential component of the preferred selective isoparaffin-synthesis catalyst is a platinum-group metal or nickel. Of the preferred platinum group, i.e., platinum, palladium, rhodium, ruthenium, osmium and iridium, palladium is a favored component and platinum is especially preferred. Mixtures of platinum-group metals also are within the scope of this invention. This component may exist within the final catalytic composite as a compound such as an oxide, sulfide, halide, or oxyhalide, in chemical combination with one or more of the other ingredients of the composite, or as an elemental metal. Best results are obtained when substantially all of this metal component is present in the elemental state. This component may be present in the final catalyst composite in any amount which is catalytically effective, and generally will comprise about 0.01 to 2 mass % of the final catalyst calculated on an elemental basis. Excellent results are obtained when the catalyst contains from about 0.05 to 1 mass % of platinum.

The platinum-group metal component may be incorporated into the selective isoparaffin-synthesis catalyst in any suitable manner such as coprecipitation or cogellation with the carrier material, ion exchange or impregnation. Impregnation using water-soluble compounds of the metal is preferred. Typical platinum-group compounds which may be employed are chloroplatinic acid, ammonium chloroplatinate, bromoplatinic acid, platinum dichloride, platinum tetrachloride hydrate, tetraamine platinum chloride, tetraamine platinum nitrate, platinum dichlorocarbonyl dichloride, dinitrodiaminoplatinum, palladium chloride, palladium chloride dihydrate, palladium nitrate, etc. Chloroplatinic acid is preferred as a source of the especially preferred platinum component.

It is within the scope of the present invention that the catalyst may contain other metal components known to modify the effect of the platinum-group metal component. Such metal modifiers may include rhenium, tin, germanium, lead, cobalt, nickel, indium, gallium, zinc, uranium, dysprosium, thallium, and mixtures thereof. Catalytically effective amounts of such metal modifiers may be incorporated into the catalyst by any means known in the art.

The composite is dried and calcined. The drying is carried out at a temperature of about 100° to 300°, followed by calcination or oxidation at a temperature of from about 375° to 600° C. in an air or oxygen atmosphere for a period of about 0.5 to 10 hours in order to convert the metallic components substantially to the oxide form.

The resultant oxidized catalytic composite is subjected to a substantially water-free and hydrocarbon-free reduction step. This step is designed to selectively reduce the platinum-group component to the corresponding metal and to insure a finely divided dispersion of the metal component throughout the carrier material. Substantially pure and dry hydrogen (i.e., less than 20 vol. ppm $H_2O$) preferably is used as the reducing agent in this step. The reducing agent is contacted with the oxidized composite at conditions including a temperature of about 425° C. to about 650° C. and a period of time of about 0.5 to 2 hours to reduce substantially all of the platinum-group metal component to its elemental metallic state.

An alternative form of the selective-isoparaffin synthesis catalyst contains a Friedel-Crafts metal halide. Suitable metal halides include aluminum chloride, aluminum bromide, ferric chloride, ferric bromide, zinc chloride and the like compounds, with the aluminum halides and particularly aluminum chloride ordinarily yielding best results. Generally, this component can be incorporated into the catalyst support of the present invention after drying and calcining by way of the conventional methods for adding metallic halides of this type; however, best results are ordinarily obtained when the metallic halide is sublimed onto the surface of the support according to the preferred method disclosed in U.S. Pat. No. 2,999,074, which is incorporated herein by reference.

As aluminum chloride sublimes at about 184° C., suitable preparation temperatures range from about 190° C. to 750° C. with a preferable range being from about 500° C to 650° C. The sublimation can be conducted at atmospheric pressure or under increased pressure and in the presence of absence of diluent gases such a hydrogen or light paraffinic hydrocarbons or both. The impregnation of the Friedel-Crafts metal halide may be conducted batch-wise, but a preferred method for impregnating the calcined support is to pass sublimed $AlCl_3$ vapors, in admixture with a carrier gas such as hydrogen, through a bed of reduced catalyst. This method both continuously deposits and reacts the aluminum chloride and also removes hydrogen chloride evolved during the reaction.

The alternative catalyst contains an amount of Friedel-Crafts metal halide combined with the calcined support ranging from about 1 up to 15 mass % relative to the calcined composite prior to introduction of the metal-halide component. The composite containing the sublimed Friedel-Crafts metal halide is treated to remove the unreacted Friedel-Crafts metal halide by subjecting the composite to a temperature above the sublimation temperature of the Friedel-Crafts metal halide, preferably below about 750° C., for a time sufficient to remove any unreacted metal halide. For $AlCl_3$, temperatures of about 500° C. to 650° C. and times of from about 1 to 48 hours are preferred. Other optional components and promoters associated with the alternative catalyst described hereinabove are disclosed in U.S. Pat. No. 5,200,059, incorporated herein by reference.

Water and sulfur are catalyst poisons especially for the chlorided platinum-alumina catalyst composition described hereinabove. Water can act to permanently deactivate the catalyst by removing high-activity chloride from the catalyst and replacing it with inactive aluminum hydroxide. Therefore, water and oxygenates that can decompose to form water can only be tolerated in very low concentrations. In general, this requires a limitation of oxygenates in the feed to about 0.1 ppm or less. Sulfur present in the feedstock serves to temporarily deactivate the catalyst by platinum poisoning. If sulfur is present in the feed, activity of the catalyst may be restored by hot hydrogen stripping of sulfur from the catalyst composition or by lowering the sulfur concentration in the incoming feed to below 0.5 ppm. The feed may be treated by any method that will remove water and sulfur compounds. Sulfur may be removed from the feed stream by hydrotreating. Adsorption systems for the removal of sulfur and water from hydrocarbon streams are well known to those skilled in the art.

Contacting within the selective-isoparaffin-synthesis zone may be effected using the catalyst in a fixed-bed system, a moving-bed system, a fluidized-bed system, or in a batch-type operation. In view of the danger of attrition loss of the valuable catalyst and of operational advantages, it is preferred to use a fixed-bed system. In this system, a hydrogen-rich gas and the charge stock are preheated by suitable heating means to the desired reaction temperature and then passed into an selective-isoparaffin-synthesis zone containing a fixed bed of the catalyst particle as previously characterized. The selective-isoparaffin-synthesis zone may be in a single reactor or in two or more separate reactors with suitable means therebetween to ensure that the desired selective-isoparaffin-synthesis temperature is maintained at the entrance to each reactor. Two or more reactors in sequence are preferred to control individual reactor temperatures in light of the exothermic heat of reaction and for partial catalyst replacement without a process shutdown. The reactants may be contacted with the bed of catalyst particles in either upward, downward, or radial flow fashion. The reactants may be in the liquid phase, a mixed liquid-vapor phase, or a vapor phase when contacted with the catalyst particles. The separation zone optimally comprises one or more fractional distillation columns having associated appurtenances, optionally along with other standard gas recovery equipment such as absorbers to minimize losses of valuable light products. The separation zone typically processes a synthesis effluent obtained from the reaction to yield an isobutane-rich stream, a light synthesis naphtha and a heavy synthesis naphtha.

The isobutane-rich stream, or isobutane concentrate, has a concentration of between about 70 and 95 mole % isobutane in total butanes and more usually in excess of 80 mole % isobutane. Optionally, an isopentane-rich stream may be recovered from the synthesis effluent either in admixture with the isobutane or as a separate stream. However, the isopentane produced in the selective-isoparaffin-synthesis zone usually is recovered in the light synthesis naphtha. The isobutane-rich stream may be further upgraded via dehydrogenation and etherification or alkylation, as described hereinafter.

The light synthesis naphtha normally comprises pentanes and hexanes in admixture, and also may contain smaller concentrations of naphthenes, benzene and $C_7$ hydrocarbons. Preferably most of the $C_6$ naphthenes are directed to the heavy synthesis naphtha and subsequently processed by ring cleavage to achieve the objective of producing an aliphatic product.

The heavy synthesis naphtha and optional hydrogen comprise combined feed to the ring-cleavage zone, which contains a nonacidic ring-cleavage catalyst and operates at suitable conditions to open naphthenic rings to form paraffins without a high degree of conversion to lighter products. The ring-cleavage catalyst comprises one or more platinum-group metals, selected from the group consisting of platinum, palladium, ruthenium, rhodium, osmium, and iridium, on a solid support which preferably comprises one or both of a refractory inorganic oxide and a zeolite. Suitable zeolites include but are not limited to MOR, FAU, LTL, MAZ, MEL, MFI, MTW and Beta.

Optimally the ring-cleavage catalyst is nonacidic, comprising a nonacidic support comprising one or more of a refractory inorganic-oxide and a large-pore molecular sieve. The "nonacidic support" has a substantial absence of acid sites, for example as an inherent property or through ion exchange with one or more basic cations. The nonacidity of the ring-cleavage support may be determined using a variety of methods known in the art. A preferred method of determining acidity is the heptene cracking test as described below. Conversion of heptene, principally by cracking, isomerization and ring formation, is measured at specified conditions. Cracking is particularly indicative of the presence of strong acid sites. A nonacidic catalyst suitable for ring cleavage demonstrates low conversion and particularly low cracking in the heptene test: conversion generally is less than 30% and cracking less than about 5%. The best supports demonstrate no more than about 5% conversion and negligible cracking.

The heptene cracking test also is effected in an atmospheric microreactor. In this test procedure an electrically heated reactor is loaded with 250 mg of 40–60 mesh particles made by crushing the sample particles. Each catalyst is dried in situ for 30 minutes at 200° C. using flowing hydrogen. The catalyst is then subjected to a reduction treatment for one hour at 550° C. in flowing hydrogen.

The reactor is then brought to the desired operational bed temperature of 425° C. The feed stream to the reactor comprises hydrogen gas saturated with 1-heptene at 0° C. and ambient atmospheric pressure. The inlet temperature is held constant while the flow rate of the 1-heptene saturated hydrogen is varied in a predetermined pattern. Analysis is performed by analyzing the effluent using a gas chromatograph. Samples for analysis are automatically taken after 15 minutes of onstream operation at 250 cc/min. feed gas flow, at 45 minutes with the feed flowrate at 500 cc/min., at 75 minutes with the feed gas flowrate at 1000 cc/min., at 105 minutes with the feed gas flowrate at 125 cc/min. and after 135 minutes with the feed gas flowrate at the initial 250 cc/min. In each instance the feed gas flowrate is adjusted after the previous sample is taken. The analytical results are reported at each elapsed time during the test in weight percent indicating the composition of the effluent stream.

Alternatively, nonacidity may be characterized by the ACAC (acetonylacetone, or 2,5-hexanedione) test. ACAC is converted over the support to be tested at specified conditions: dimethylfuran in the product is an indicator of acidity, while methylcyclopentenone indicates basicity. Conversion over the support of the invention during a 5-minute period at 150° C. at a rate of 100 cc/min should yield less than 5 mass %, and preferably less than 1%, acid products. Conversion to basic products can usefully be in the range of 0–70 mass %.

Another useful method of measuring acidity is $NH_3$-TPD (temperature-programmed desorption) as disclosed in U.S. Pat. No. 4,894,142, incorporated herein by reference; the $NH_3$-TPD acidity strength should be less than about 1.0. Other methods such as $^{31}P$ solids NMR of adsorbed TMP (trimethylphosphine) also may be used to measure acidity.

The preferred nonacidic support optimally comprises a porous, adsorptive, high-surface-area inorganic oxide having a surface area of about 25 to about 500 $m^2/g$. The porous support should also be uniform in composition and relatively refractory to the conditions utilized in the process. By the term "uniform in composition," it is meant that the support be unlayered, has no concentration gradients of the species inherent to its composition, and is completely homogeneous in composition. Thus, if the support is a mixture of two or more refractory materials, the relative amounts of these materials will be constant and uniform throughout the entire support. It is intended to include within the scope of the present invention refractory inorganic oxides such as alumina, titania, zirconia, chromia, zinc oxide, magnesia, thoria, boria, silica-alumina, silica-magnesia, chromia-alumina, alumina-boria, silica-zirconia and other mixtures thereof.

The preferred refractory inorganic oxide for use in the present invention comprises alumina. Suitable alumina materials are the crystalline aluminas known as the theta- , alpha- , gamma- , and eta-alumina, with theta- , alpha- , and gamma-alumina giving best results. Magnesia, alone or in combination with alumina, comprises an alternative inorganic-oxide component of the catalyst and provides the required nonacidity. The preferred refractory inorganic oxide will have an apparent bulk density of about 0.3 to about 1.1 g/cc and surface area characteristics such that the average pore diameter is about 20 to 1000 angstroms, the pore volume is about 0.05 to about 1 cc/g, and the surface area is about 50 to about 500 $m^2/g$.

The inorganic-oxide powder may be formed into a suitable catalyst material according to any of the techniques known to those skilled in the catalyst-carrier-forming art. Spherical carrier particles may be formed, for example, from the preferred alumina by: (1) converting the alumina powder into an alumina sol by reaction with a suitable peptizing acid and water and thereafter dropping a mixture of the resulting sol and a gelling agent into an oil bath to form spherical particles of an alumina gel which are easily converted to a gamma-alumina support by known methods; (2) forming an extrudate from the powder by established methods and thereafter rolling the extrudate particles on a spinning disk until spherical particles are formed which can then be dried and calcined to form the desired particles of spherical support; and (3) wetting the powder with a suitable peptizing agent and thereafter rolling the particles of the powder into spherical masses of the desired size. The powder can also be formed in any other desired shape or type of support known to those skilled in the art such as rods, pills, pellets, tablets, granules, extrudates, and like forms by methods well known to the practitioners of the catalyst material forming art.

A favored form of carrier material for the ring-cleavage catalyst is a cylindrical extrudate. The extrudate particle is optimally prepared by mixing the preferred alumina powder with water and suitable peptizing agents such as nitric acid, acetic acid, aluminum nitrate, and the like material until an extrudable dough is formed. The amount of water added to form the dough is typically sufficient to give a Loss on Ignition (LOI) at 500° C. of about 45 to 65 mass %, with a value of 55 mass % being especially preferred. The resulting dough is then extruded through a suitably sized die to form extrudate particles.

The extrudate particles are dried at a temperature of about 150° to 200° C., and then calcined at a temperature of about 450° to 800° C. for a period of 0.5 to 10 hours to effect the preferred form of the refractory inorganic oxide.

It is essential that the catalyst be non-acidic, as acidity lowers selectivity to paraffins in ring cleavage. The required nonacidity may be effected by any suitable method, including impregnation, co-impregnation with a platinum-group metal, or ion exchange. Impregnation of one or more of the alkali and alkaline earth metals, preferably one or both of potassium and lithium and especially potassium, in a salt solution is favored as being an economically attractive method. The metal effectively is associated with an anion such as hydroxide, nitrate or a halide such as chloride or bromide consistent with nonacidity of the finished catalyst, with a nitrate being favored. Optimally, the support is cold-rolled with an excess of solution in a rotary evaporator in an amount sufficient to provide a nonacidic catalyst. The alkali or alkaline earth metal may be coimpregnated with a platinum-group metal component, as long as the platinum-group metal does not precipitate in the presence of the salt of the alkali or alkaline earth metal.

Ion exchange is an alternative method of incorporating nonacidity into the catalyst. The inorganic-oxide support is contacted with a solution containing an excess of metal ions over the amount needed to effect nonacidity. Although any suitable method of contacting may be used, an effective method is to circulate a salt solution over the support in a fixed-bed loading tank. A water-soluble metal salt of an alkali or alkaline earth metal is used to provide the required metal ions; a potassium salt is particularly preferred. The support is contacted with the solution suitably at a temperature ranging from about 10° to about 100° C.

An alternative suitable support having inherent nonacidity may be termed a "synthetic hydrotalcite" characterized as a layered double hydroxide or metal-oxide solid solution. Hydrotalcite is a clay with the ideal unit cell formula of $Mg_6Al_2(OH)_{16}(CO_3)4H_2O$, and closely related analogs with variable magnesium/aluminum ratios may be readily prepared. W. T. Reichle has described in the *Journal of Catalysis,* 94, 547–557 (1985), the synthesis and catalytic use of such synthetic hydrotalcites, including materials having Mg and Al replaced by other metals. Calcination of such layered double hydroxides results in destruction of the layered structure and formation of materials which are effectively described as solid solutions of the resulting metal oxides.

These embodiments of the present support are disclosed in copending application Ser. No. 987,838, incorporated by reference, and are solid solutions of a divalent metal oxide and a trivalent metal oxide having the general formula $(M^{+2}{}_xO)M^{+3}{}_yO)OH_y$ derived by calcination of synthetic hydrotalcite-like materials whose general formula may be expressed as $(M^2)_x(M^{+3})_y(OH)_zA_q rH2O$. $M^{+2}$ is a divalent metal or combination of divalent metals selected from the group consisting of magnesium, calcium, barium, nickel, cobalt, iron, copper and zinc. $M^{+3}$ is a trivalent metal or combination of trivalent metals selected from the group consisting of aluminum, gallium, chromium, iron, and lanthanum. Both $M^{+2}$ and $M^{+3}$ may be mixtures of metals belonging to the respective class: for example, $M^{+2}$ may be pure nickel or may be both nickel and magnesium, or even nickel-magnesium-cobalt; $M^{+3}$ may be solely aluminum or a mixture of aluminum and chromium, or even a mixture of three trivalent metals such as aluminum, chromium, and gallium. $A_q$ is an anion, most usually carbonate although other anions may be employed equivalently, especially anions such as nitrate, sulfate, chloride, bromide, hydroxide, and chromate. The case where $M^{+2}$ is magnesium, $M^{+3}$ is aluminum, and A is carbonate corresponds to the hydrotalcite series.

It is preferable that the $(M^{+2}{}_xO)(M^{+3}{}_yO)OH_y$ solid solution has a surface area at least about 150 $m^2/g$, more preferably at least 200 $m^2/g$ and it is even more preferable that it be in the range from 300 to 350 $m^2/g$. The ratio x/y of the divalent and trivalent metals can vary between about 2 and about 20, with the ratios of 2 to about 10 being preferred.

Preparation of suitable basic metal-oxide supports is described in detail in the referenced copending application Ser. No. 987,838. Precursor gel is prepared at a temperature not exceeding about 10° C., and preferably is prepared in the temperature interval between about 0° and 5° C. In addition, the crystallization time is kept short, on the order of an hour or two at 65° C., to afford layered double hydroxides whose calcination leads to materials of unusual hydrothermal stability. Calcination of the layered double hydroxide is effected at temperatures between about 400° and about 750° C. Unusual stability and homogeneity is evidenced by the fact that spinel formation is not seen until calcination temperatures of about 800° C., whereas the spinel phase begins to appear in prior-art hydrotalcite-type layered double hydroxides at a calcination temperature of about 600° C.

In the above embodiments of the ring-cleavage catalyst composition comprising an inorganic-oxide support, the catalyst favorably is substantially free of microcrystalline porous material, i.e., a molecular sieve, and in particular is substantially zeolite-free. In yet another alternative embodiment, however, the ring-cleavage catalyst contains a non-acidic large-pore molecular sieve, an alkali-metal component and a platinum-group metal component.

It is essential that the molecular sieve of this alternative embodiment be non-acidic, as acidity in the sieve lowers the selectivity for ring cleavage of the finished catalyst. In order to be "non-acidic," the sieve has substantially all of its cationic exchange sites occupied by nonhydrogen species. Preferably the cations occupying the exchangeable cation sites will comprise one or more of the alkali metals, although other cationic species may be present. An especially preferred nonacidic large-pore molecular sieve is potassium-form L-zeolite.

Generally the large-pore molecular sieve is composited with a binder in order to provide a convenient form for use in the catalyst of the present invention. The art teaches that any refractory inorganic oxide binder is suitable. One or more of silica, alumina or magnesia are preferred binder materials of the present invention. Excellent results are obtained when using a synthetic white silica powder precipitated as ultra-fine spherical particles from a water solution, providing a silica binder which is nonacidic, contains less than 0.3 mass % sulfate salts, and has a BET surface area of from about 120 to 160 $m^2/g$.

The large-pore molecular sieve and binder may be composited to form the desired catalyst shape by any method known in the art. For example, the preferred potassium-form L-zeolite and amorphous silica may be commingled as a uniform powder blend prior to introduction of a peptizing agent. An aqueous solution comprising sodium hydroxide is added to form an extrudable dough. The dough preferably will have a moisture content of from 30 to 50 mass % in order to form extrudates having acceptable integrity to withstand direct calcination. The resulting dough is extruded through a suitably shaped and sized die to form extrudate particles, which are dried and calcined by known methods. Alternatively, spherical particles may be formed by methods described hereinabove for the inorganic-oxide ring-cleavage catalyst.

An alkali-metal component is an optional constituent of the sieve-containing ring-cleavage catalyst. One or more of the alkali metals, including lithium, sodium, potassium, rubidium, cesium and mixtures thereof, may be used, with potassium being preferred. The alkali metal optimally will occupy essentially all of the cationic exchangeable sites of the non-acidic large-pore molecular sieve. Surface-deposited alkali metal also may be present as described in U.S. Pat. No. 4,619,906, incorporated herein in by reference thereto.

The platinum-group metal component, comprising one or more of a platinum, palladium, rhodium, ruthenium, iridium or osmium component with a platinum component being preferred, is another essential feature of the ring-cleavage catalysts. This metal component may exist within the catalyst as a compound such as the oxide, sulfide, halide, or oxyhalide, in chemical combination with one or more other ingredients of the catalytic composite, or as an elemental metal. Best results are obtained when substantially all of the metal exists in the catalytic composite in a reduced state. The platinum-group metal component generally comprises from about 0.05 to 5 mass % of the catalytic composite, preferably 0.05 to 2 mass %, calculated on an elemental basis.

The platinum-group metal component may be incorporated into the isomerization catalyst in any suitable manner such as coprecipitation or cogellation with the carrier material, ion exchange or impregnation. Impregnation using water-soluble compounds of the metal is preferred. Typical platinum-group compounds which may be employed are chloroplatinic acid, ammonium chloroplatinate, bromoplatinic acid, platinum dichloride, platinum tetrachloride hydrate, tetraamine platinum chloride, tetraamine platinum nitrate, platinum dichlorocarbonyl dichloride, dinitrodiaminoplatinum, palladium chloride, palladium chloride dihydrate, palladium nitrate, etc. Chloroplatinic acid or tetraamine platinum chloride are preferred as the source of the preferred platinum component.

It is within the scope of the present invention that the catalyst may contain supplemental metal components known to modify the effect of the preferred platinum component. Such metal modifiers may include Group IVA(14) metals, other Group VIII(8–10) metals, rhenium, indium, gallium, bismuth, zinc, uranium, dysprosium, thallium and mixtures thereof. One or more of rhenium, germanium, tin, lead, gallium, indium and bismuth are preferred modifier metals. Catalytically effective amounts of such metal modifiers may be incorporated into the catalyst by any means known in the art.

The final ring-cleavage catalyst generally will be dried at a temperature of from about 100° to 320° C. for about 0.5 to 24 hours, followed by oxidation at a temperature of about 300° to 550° C. in an air atmosphere which preferably contains a chlorine component for 0.5 to 10 hours. Preferably the oxidized catalyst is subjected to a substantially water-free reduction step at a temperature of about 300° to 550° C. for 0.5 to 10 hours or more. The duration of the reduction step should be only as long as necessary to reduce the platinum, in order to avoid pre-deactivation of the catalyst, and may be performed in-situ as part of the plant startup if a dry atmosphere is maintained.

The above catalysts have been found to provide satisfactory cleavage of rings in a naphtha feedstock at conditions including temperatures within the range of from about 100° to 550° C. and preferably 200° to 450° C., with higher temperatures being more appropriate for feedstocks with higher cyclics contents and lower temperatures favoring saturation of aromatic compounds in the feed. Operating pressures range from about 100 kPa to 10 MPa absolute, preferably between about 0.5 and 4 MPa. Hydrogen to hydrocarbon molar ratios relative to the feedstock are in the range of about 0.1 to 100, preferably between about 0.5 and 10. Liquid hourly space velocities (LHSV) range from about 0.1 to 30, and optimally are in the range of about 0.5 to 10.

The paraffinic intermediate from the ring-cleavage zone has a low cyclics content relative to the heavy-synthesis-naphtha feedstock. At least about 50%, preferably at least about 60%, and more advantageously about 70% or more of the naphthenes in the feedstock are converted in the ring-cleavage zone by selective ring opening according to the invention to form principally paraffins having the same carbon number as the converted naphthenes. Ring-cleavage selectivity, expressed as mass % yield of paraffins having the same carbon number as the naphthenes converted, is at least about 90% and preferably about 95% or more. Aromatics in the feedstock which have been saturated in the ring-cleavage zone to form naphthenes are converted to paraffins to a similar extent. Through saturation with hydrogen, the aromatics content generally is reduced about 90% or more relative to that of the naphtha feedstock; usually the aromatics content will be less than about 0.1 mass %, and often in the region of about 100 mass ppm or less, although such low levels are not critical to the utility of the process combination.

Although hydrogen and light hydrocarbons may be removed by flash separation and/or fractionation from the paraffinic intermediate between the ring-cleavage zone and the selective-isoparaffin-synthesis zone, the intermediate preferably is transferred between zones without separation of hydrogen or light hydrocarbons. Optionally, the paraffinic intermediate may be transferred between zones without external heating or cooling although a cooler or other heat exchanger between the ring-cleavage zone and isomerization zone may be appropriate for temperature flexibility or for the startup of the process combination.

Contacting within the ring-cleavage zone may be effected using the catalyst in a fixed-bed system, a moving-bed system, a fluidized-bed system, or in a batch-type operation. A fixed-bed system is preferred. The reactants may be contacted with the bed of catalyst particles in either upward, downward, or radial-flow fashion. The reactants may be in the liquid phase, a mixed liquid-vapor phase, or a vapor phase when contacted with the catalyst particles.

The present process combination is particularly effective in the context of a petroleum refinery containing such conventional processing units as distillation, hydrotreating, isomerization, reforming, alkylation, oligomerization, cracking, heavy-oil conversion and light-ends recovery. Finished gasoline may be produced by blending the gasoline components derived from the process combination with other constituents including but not limited to one or more of butanes, butenes, pentanes, naphtha, catalytic reformate, isomerate, alkylate, polymer, aromatic extract, heavy aromatics; gasoline from catalytic cracking, hydrocracking, thermal cracking, thermal reforming, steam pyrolysis and coking; oxygenates from sources outside the combination such as methanol, ethanol, propanol, isopropanol, TBA, SBA, MTBE, ETBE, MTAE, DIPE and higher alcohols and ethers; and small amounts of additives to promote gasoline stability and uniformity, avoid corrosion and weather problems, maintain a clean engine and improve driveability.

EXAMPLES

The following examples serve to illustrate certain specific embodiments of the present invention. These examples should not, however, be construed as limiting the scope of the invention as set forth in the claims. There are many possible other variations, as those of ordinary skill in the art will recognize, which are within the spirit of the invention.

EXAMPLE 1

The feedstock used in Examples 2–5 was a straight-run naphtha derived from Seagull Uinta Basin crude oil having the following characteristics:

| | |
|---|---|
| Specific gravity | 0.745 |
| Distillation, ASTM D-86, °C. | |
| IBP | 85 |
| 50% | 135 |
| 90% | 177 |
| EP | 214 |
| Mass % paraffins | 65 |
| naphthenes | 23 |
| aromatics | 12 |
| Mass % $C_5$ | 0.2 |
| $C_6$ | 12.1 |
| $C_7$+ | 87.7 |

EXAMPLE 2

Selective isoparaffin synthesis was carried out on the naphtha of Example 1 using a solid acid selective isoparaffin synthesis catalyst comprising platinum-$AlCl_3$-alumina as disclosed hereinabove. Selective isoparaffin synthesis was effected in a hydrogen atmosphere at a pressure of 3 MPa gauge and a liquid hourly space velocity of 2.0 $hr^{-1}$. A platinum-on-alumina aromatics-saturation catalyst amounting to ⅓ of the volume of the selective isoparaffin-synthesis catalyst was loaded into the reactor ahead of the synthesis catalyst. Conversion of $C_7$+ was varied over a range as indicated below by varying temperature from 120° to 180° C.

The table below shows product distributions, conversion of cyclics in the feedstock, naphtha end point reduction and isobutane content of the butane product for $C_7$+ conversion ranging from 28% to 57%:

| Conversion: | 28% | 49% | 57% |
|---|---|---|---|
| Product, mass %: | | | |
| $C_3$ and lighter | 0.3 | 1.4 | 3.1 |
| Butanes | 8.6 | 18.7 | 24.7 |
| Pentanes | 7.2 | 12.8 | 14.6 |
| $C_6$ and heavier | 83.9 | 67.1 | 57.6 |
| Cyctics conv., % | 2.4 | 7.8 | 16.2 |
| $C_5$ + endpoint, °C. | 192 | 158 | 139 |
| Isobutane/$C_4$ | .95 | .93 | .90 |

EXAMPLE 3

Selective isoparaffin synthesis was carried out on the above full-range naphtha using a Y-zeolite-based (FAU) catalyst. The extruded catalyst base comprised 80 mass %-zeolite and 20 mass % alumina. Platinum was impregnated on the base in a solution of 0.7% nitric acid to achieve a level of 0.29 mass % Pt on the finished catalyst. The catalyst was oxidized and reduced at 525° C. before being loaded into the reactor.

Selective isoparaffin synthesis was effected in a hydrogen atmosphere at a pressure of 3 MPa gauge and a liquid hourly space velocity of 2.0 $hr^{-1}$. Conversion of $C_7$+ was varied over a range of 6% to 94% by varying temperature from 220° to 271° C. The table below shows product distributions, conversion of cyclics in the feedstock, naphtha end point reduction and isobutane content of the butane product for a middle range of $C_7$+ conversions:

| Conversion: | 28% | 47% | 61% |
|---|---|---|---|
| Product, mass %: | | | |
| $C_3$ and lighter | 1.4 | 4.3 | 6.0 |
| Butanes | 8.2 | 10.2 | 20.5 |

-continued

| Conversion: | 28% | 47% | 61% |
|---|---|---|---|
| Pentanes | 8.3 | 14.4 | 15.9 |
| $C_6$ and heavier | 82.1 | 71.1 | 57.6 |
| Cyclics conv., % | 8.1 | 14.8 | 31.3 |
| $C_5$ + end point °C. | 183 | 157 | 142 |
| Isobutane/$C_4$ | .79 | .88 | .77 |

Figure 2:
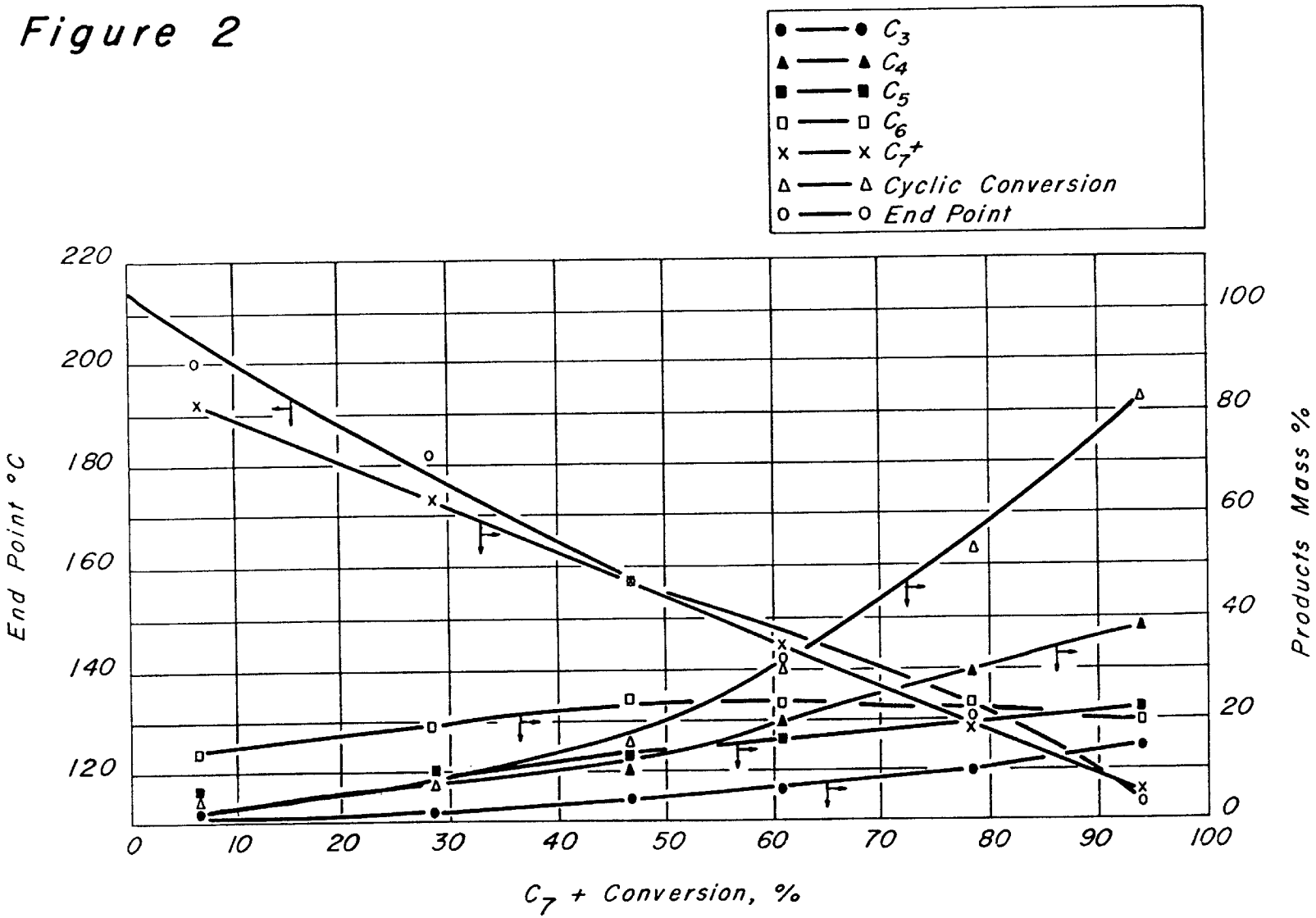
FIG. 2 shows selective isoparaffin synthesis yields and temperature requirements using a FAU zeolite-containing catalyst.

Data from the full range of $C_7$+ conversion are plotted in FIG. 2.

EXAMPLE 4

Selective isoparaffin synthesis was carried out on the above full-range naphtha using a Beta-zeolite-based catalyst. The extruded catalyst base comprised 70 mass % Beta-zeolite and 30 mass % alumina. Platinum was impregnated on the base in a 2% HCl solution to achieve a level of 0.29 mass % Pt on the finished catalyst. The catalyst was oxidized and reduced before being loaded into the reactor behind an aromatics-saturation catalyst.

Selective isoparaffin synthesis was effected in a hydrogen atmosphere at a pressure of 3 MPa gauge and a liquid hourly space velocity of 2.0 $hr^{-1}$. Conversion of $C_7$+ was varied over a range of about 28% to 94% by varying temperature from 245° to 280° C. The table below shows product distributions, conversion of cyclics in the feedstock, naphtha end point reduction and isobutane content of the butane product for a middle range of $C_7$+ conversions:

| Conversion: | 28% | 49% | 70% |
|---|---|---|---|
| Product, mass %: | | | |
| $C_3$ and lighter | 1.7 | 3.7 | 7.9 |
| Butanes | 8.3 | 17.2 | 26.8 |
| Pentanes | 7.6 | 13.0 | 16.7 |
| $C_6$ and heavier | 82.4 | 66.1 | 48.6 |
| Cyclics conv., % | 6.5 | 17.0 | 38.3 |
| $C_5$ + end point, °C. | 172 | 158 | 152 |
| Isobutane/$C_4$ | .72 | .79 | .77 |

Figure 3:
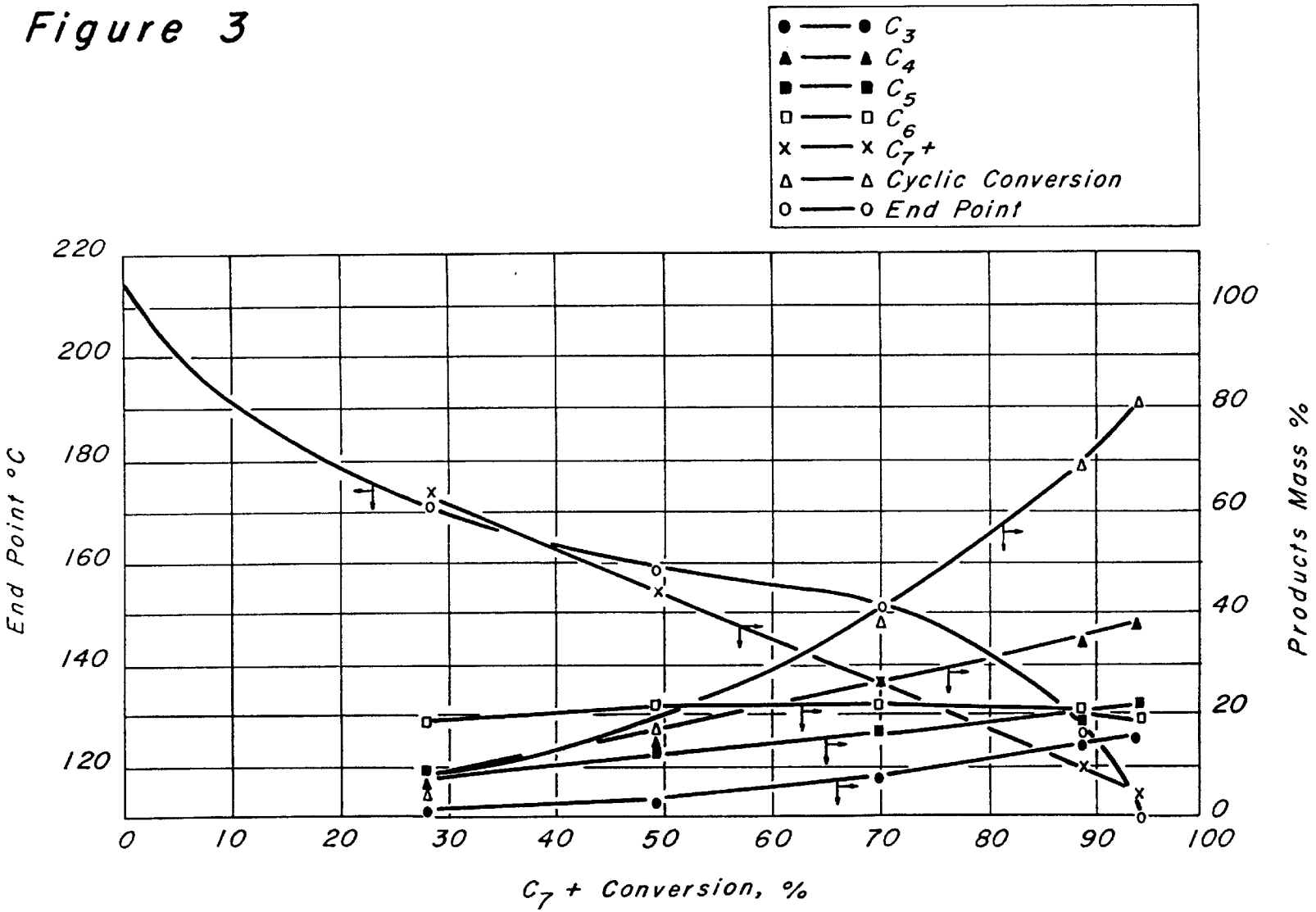
FIG. 3 shows selective isoparaffin synthesis yields and temperature requirements using a Beta-zeolite-containing catalyst.

Data from the full range of $C_7$+ conversions are plotted in FIG. 3.

EXAMPLE 5

Selective isoparaffin synthesis was carried out on the above full-range naphtha using an oil-dropped spherical catalyst comprising sulfuric acid impregnated on a zirconia base. Platinum was impregnated to achieve a level of 0.92 mass % Pt on the finished catalyst. The catalyst was oxidized and reduced before being loaded into the reactor behind an aromatics-saturation catalyst.

Selective isoparaffin synthesis was effected in a hydrogen atmosphere at a pressure of 3 MPa gauge and a liquid hourly space velocity of 2.0 $hr^{-1}$. Conversion of $C_7$+ was varied over a range of about 46% to 83% by varying temperature from 177° to 220° C. The table below shows product distributions, conversion of cyclics in the feedstock, naphtha end point reduction and isobutane content of the butane product for a middle range of $C_7$+ conversions:

| Conversion: | 46% | 65% | 73% |
|---|---|---|---|
| Product, mass %: | | | |
| $C_3$ and lighter | 3.1 | 6.9 | 8.8 |
| Butanes | 15.5 | 24.4 | 28.4 |
| Pentanes | 11.9 | 15.3 | 16.7 |
| $C_6$ and heavier | 69.5 | 59.8 | 46.1 |
| Cyclics conv., % | 6.2 | 22.4 | 33.2 |
| $C_5$ + end point, °C.* | 171 | 158 | 158 |
| Isobutane/$C_4$ | .85 | .84 | .81 |

Figure 4:
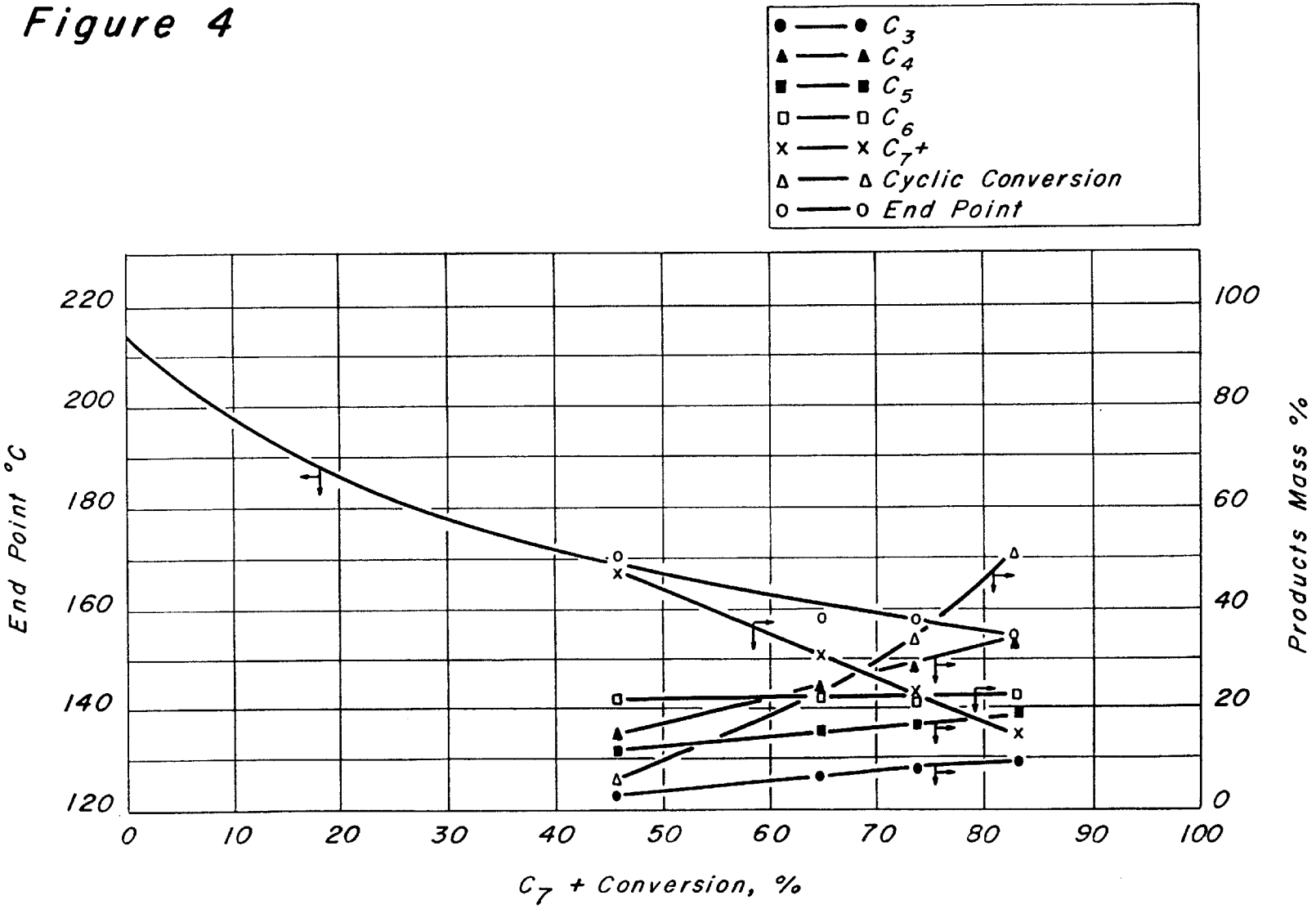
FIG. 4 shows selective isoparaffin synthesis yields and temperature requirements using a catalyst comprising sulfate incorporated into a zirconia support.

Data from the full range of $C_7$+ conversions are plotted in FIG. 4.

EXAMPLE 6

Yields were estimated for selective isoparaffin synthesis without and with ring cleavage on a recycle stream. Three feedstocks: straight-run naphtha (SRN) fractionated from crude-oil, naphtha derived from coking of residue, and gasoline from fluid catalytic cracking (FCC) were studied with properties derived after hydrotreating in preparing the estimates:

| Feedstock Source: | Straight-Run | Coker | FCC |
|---|---|---|---|
| Specific gravity | 0.765 | 0.747 | 0.780 |
| Distillation, ASTM D-86, °C. | | | |
| IBP | 96 | 88 | 31 |
| 50% | 125 | 128 | 139 |
| 90% | 150 | 151 | 168 |
| EP | 177 | 171 | 196 |
| Vol. % paraffins | 47.7 | 62.5 | 43.7 |
| naphthenes | 33.1 | 26.1 | 17.3 |
| aromatics | 19.2 | 11.4 | 39.0 |

EXAMPLE 7

Once-through selective-isoparaffin-synthesis yields were estimated on the basis of using a solid-acid selective-isoparaffin-synthesis catalyst as disclosed in Example 2 in a hydrogen atmosphere at a pressure of 3 MPa gauge:

| Feedstock Source: | SRN | Coker | FCC |
|---|---|---|---|
| Hydrogen consumption, mass-% | 2.0 | 1.6 | 3.0 |
| Product, mass %: | | | |
| $C_3$ and lighter | 2.0 | 2.4 | 1.6 |
| Butanes | 23.9 | 29.9 | 17.8 |
| Pentanes | 9.2 | 11.9 | 12.7 |
| $C_6$ and heavier | 66.9 | 57.4 | 70.9 |
| $C_5$+ end point, °C.* | 144 | 145 | 154 |
| Isobutane/$C_4$ | .91 | .91 | .91 |

EXAMPLE 8

Selective isoparaffin synthesis yields were estimated on the feedstocks of Example 6 using the same catalyst and conditions, with recycle of $C_8$+ components to a ring-cleavage zone. The ring-cleavage catalyst used in the estimate comprised Ni-W on bound Y-zeolite (FAU). Yields were estimated as follows:

| Feedstock Source: | SRN | Coker | FCC |
|---|---|---|---|
| Recycle/feed, volume | 0.27 | 0.24 | 0.35 |
| Hydrogen consumption, mass-% | 2.6 | 2.2 | 3.8 |
| Product, mass %: | | | |
| $C_3$ and lighter | 6.4 | 6.4 | 7.1 |
| Butanes | 32.6 | 38.0 | 28.6 |
| Pentanes | 13.1 | 16.0 | 18.8 |
| $C_6$ and heavier | 50.5 | 41.8 | 49.3 |
| $C_5$+ end point, °C.* | 129 | 132 | 133 |
| Isobutane/$C_4$ | .87 | .88 | .85 |

The increase in yield of butanes and pentanes and reduction in end point relative to the once-through operation are particularly notable.

EXAMPLE 9

The following acidic catalysts, containing platinum as indicated, were prepared and impregnated with platinum as taught in the references for the purpose of testing their ring-cleavage capability:

| Catalyst | Description | % Pt | U.S. Pat. |
|---|---|---|---|
| A | mordenite | 0.3 | 4,735,929 |
| B | Y zeolite | 0.3 | 5,013,699 |
| C | MFI | 0.3 | 3,702.886 |
| D | SAPO-11 | 0.3 | 4,440,871 |
| E | Beta zeolite | 0.3 | 5,116,794; Re 28,341 |
| F | Omega zeolite | 0.3 | 5,139,761; 4,241,036 |
| G | Alumina, Cl, Sn | 0.375 | 3,702,294 |
| H | Alumina, Cl | 0.375 | 2,479,110 |

EXAMPLE 10

The acidic catalysts described in Example 9 were microreactor-tested for efficiency in ring cleavage. The feed was substantially pure methylcyclopentane, and the tests were performed at a temperature of 350° C., a hydrogen/hydrocarbon mol ratio of 60, and a liquid hourly space velocity of 2.0. At the specified conversions, ring-cleavage selectivity was measured as mass % yield of paraffins, dehydrogenation selectivity as mass % aromatics, and cracking selectivity as mass % $C_1$–$C_5$ hydrocarbons:

| Catalyst | Conver. | Cleavage | Dehydro. | Cracking |
|---|---|---|---|---|
| A | 46.0 | 6.7 | 72.0 | 5 4 |
| B | 13.7 | 8.7 | 55.9 | 2.3 |
| C | 21.7 | 26.1 | 50.5 | 8.9 |
| D | 5.3 | 42.4 | 46.4 | 1.0 |
| E | 58.4 | 2.8 | 90.5 | 1.0 |
| F | 15.9 | 2.0 | 65.9 | 2.0 |
| G | 1.5 | 68.0 | 25.1 | 1.4 |
| H | 18.8 | 69.0 | 18.8 | 3.4 |

The prior-art catalysts generally showed high selectivity to aromatics rather than the desired ring cleavage. The most effective catalysts, G and H, operated at less than 20% conversion and achieved less than 70% selectivity for ring opening.

EXAMPLE 11

A catalyst was prepared by the impregnation of hydrotalcite to compare ring-cleavage performance against acidic catalysts of the prior art.

A 2 L, 3-necked round bottomed flask was equipped with an addition funnel, a thermometer, a mechanical stirrer, and a heating mantle. To this flask was added a solution containing 610 g of water, 60 g of $Na_2CO_3 \cdot H_2O$ and 71 g of NaOH and the contents were cooled to 5° C. The addition funnel was charged with a solution of 345 g water, 77 g $Mg(NO_3)_2 \cdot 6H_2O$ and 75 g $Al(NO_3)_3 \cdot 9H_2O$ and this solution was added over a period of 4 hours. The solution temperature was maintained at, 5° C. throughout the addition and the resulting slurry was stirred for 1 hour at, 5° C. The addition funnel was replaced by a reflux condenser and the slurry was heated to 60°±50° C. for 1 hour. The slurry was then cooled to room temperature and the solids recovered by filtration. The solids were washed with 10 L of hot deionized water. The solids were then dried at 100° C. for 16 hours and this product was characterized as hydrotalcite by its x-ray diffraction (XRD) pattern. After crushing, the solid was calcined at 450° C. for 12 hours in a muffle furnace with an air flow. This product was characterized as a $MgO$-$Al_2O_3$ solid solution (Mg/Al=1.5) by XRD. The BET surface area for this material was 285 $m^2$g.

Catalyst X was prepared using organic Pt impregnation. The aforementioned solid solution in an amount of 42.6 g was impregnated with 1.246 g of Pt-ethylhexanoate in 50 cc acetone. After mixing support and solution for 3 hours the excess of acetone was evaporated and catalyst was dried at 200° C. in 3600 cc/hr air for 3 hours and reduced with $H_2$ for 2 hours. The finished catalyst contained 0.75% Pt.

EXAMPLE 12

Two nonacidic aluminas of invention were prepared by the addition of K to compare ring-cleavage performance with acidic catalysts of the prior art.

Catalyst Y was prepared by the impregnation of 77.4 g gamma alumina with 120 cc water solution of 1.24 g $Pt(NH_3)_4Cl_2$, as above 3.05 g $KNO_3$ and 2.2 g $HNO_3$ in the rotary evaporator. After 2 hours of cold roll and excess of solution was evaporated for 2 hours and catalyst calcined and reduced as disclosed hereinabove. The finished catalyst contained 0.9% Pt and 1.5% K and had a B-E-T surface area of 180 $m^2$/g.

Catalyst Z was prepared following the same procedure as catalyst Y but 59 g of theta alumina were impregnated with 0.525 g $Pt(NH_3)_4Cl_2$ and 0.437 g of $KNO_3$. The finished catalyst contained 0.9% Pt and 0.79% K and had a B-E-T surface area of 80 $m^2$/g.

EXAMPLE 13

Catalysts X, Y and Z of the invention were tested for efficiency in ring cleavage in the manner described in Example 10 for acidic catalysts of the prior art. The feed was substantially pure methylcyclopentane, and the tests were performed at a temperature of 350° C., a hydrogen/hydrocarbon mol ratio of 60, and a liquid hourly space velocity of 2.0. At the specified conversions, ring-cleavage selectivity was measured as mass % yield of paraffins having the same carbon number, dehydrogenation selectivity as mass % aromatics, and cracking selectivity as mass % $C_1$–$C_5$ hydrocarbons:

| Catalyst | Conver. | Cleavage | Dehydro. | Cracking |
|---|---|---|---|---|
| X | 60.9 | 96.5 | 0.7 | 1.6 |
| Y | 68.5 | 98.6 | 0.5 | 0.9 |

-continued

| Catalyst | Conver. | Cleavage | Dehydro. | Cracking |
|---|---|---|---|---|
| Z | 77.3 | 97.6 | 0.9 | 0.9 |

The nonacidic catalysts of the invention demonstrated surprisingly high efficiency for ring cleavage compared to the Example 6 acidic catalysts of the prior art.

We claim as our invention:

1. A process combination for selectively upgrading a heavy naphtha feedstock to obtain lower-boiling hydrocarbons comprising the steps of:

(a) contacting the heavy naphtha fraction with a solid acid selective isoparaffin-synthesis catalyst in a selective-isoparaffin-synthesis zone maintained at selective-isoparaffin-synthesis conditions comprising a pressure of from about 1 MPa to 10 MPa gauge, a molar hydrogen-to-hydrocarbon ratio of from about 0.1 to 10, a liquid hourly space velocity of from about 0.5 to 20 $hr^{-1}$, and a temperature of from 50° to 350° C. and recovering a synthesis effluent having a reduced end point relative to the heavy naphtha fraction;

(b) separating the synthesis effluent in a separation zone to obtain an isobutane concentrate amounting to at least 8.0 volume % of the heavy naphtha fraction, a light synthesis naphtha comprising pentanes and a heavy synthesis naphtha;

(c) contacting at least a portion of the heavy synthesis naphtha in a ring-cleavage zone with a nonacidic ring-cleavage catalyst comprising at least one platinum-group metal component and a support comprising a nonacidic inorganic oxide at cleavage conditions comprising a temperature of from about 100° to 550° C., pressure of from about 100 kPa to 10 MPa and liquid hourly space velocity of from about 0.1 to 30 $hr^{-1}$ to convert at least about 50% of naphthenes in the heavy synthesis naphtha to yield at least about 90% of paraffins having the same carbon number as the naphthenes converted and obtain a paraffinic intermediate; and, (d) contacting the paraffinic intermediate, in combination with the heavy naphtha feedstock, with the selective isoparaffin-synthesis catalyst in the selective-isoparaffin-synthesis zone of step (a) at selective-isoparaffin conditions to obtain additional synthesis effluent.

2. The process combination of claim 1 wherein hydrogen is present in the ring-cleavage zone in an amount of from about 0.01 to 100 moles per mole of $C_5$+ hydrocarbons present in the zone.

3. The process combination of claim 2 wherein the paraffinic intermediate is transferred from the ring-cleavage zone to the selective-isoparaffin-synthesis zone without separation of hydrogen or light hydrocarbons.

4. The process combination of claim 1 wherein the isobutane concentrate of step (b) comprises isobutane in a ratio to normal butane substantially above the thermodynamic-equilibrium ratio at the selective-isoparaffin-synthesis conditions.

5. The process combination of claim 1 wherein the inorganic oxide comprises alumina.

6. The process combination of claim 5 wherein the support comprises one or both of potassium-exchanged and lithium-exchanged alumina.

7. The process combination of claim 1 wherein the support of step (c) comprises a metal-oxide solid solution.

8. The process combination of claim 1 wherein the support of step (c) comprises nonacidic L-zeolite.

9. The process combination of claim 1 wherein the platinum-group metal component of step (c) comprises a platinum component.

10. The process combination of claim 1 wherein the heavy naphtha feedstock comprises a catalytically cracked gasoline.

11. The process combination of claim 1 further comprising contacting the heavy naphtha feedstock in a hydrogenation zone with a hydrogenation catalyst comprising a platinum-group metal component and a refractory inorganic oxide in the presence of hydrogen at hydrogenation conditions including a pressure of from about 1 to 10 MPa, a temperature of at least 30° C., and a liquid hourly space velocity of from about 1 to 8 $hr^{-1}$ to produce a saturated intermediate as feed to the selective-isoparaffin-synthesis zone of step (a).

12. A process combination for selectively upgrading a heavy naphtha feedstock to obtain lower-boiling hydrocarbons comprising the steps of:

(a) contacting the heavy naphtha fraction with a solid acid selective isoparaffin-synthesis catalyst in a selective-isoparaffin-synthesis zone maintained at selective-isoparaffin-synthesis conditions comprising a pressure of from about 1 MPa to 10 MPa gauge, a molar hydrogen-to-hydrocarbon ratio of from about 0.1 to 10, a liquid hourly space velocity of from about 0.5 to 20 $hr^{-1}$, and a temperature of from about 50° to 350° C. and recovering a synthesis effluent having a reduced end point relative to the heavy naphtha fraction;

(b) separating the synthesis effluent in a separation zone to obtain an isobutane concentrate amounting to at least 8.0 volume % of the heavy naphtha fraction, a light synthesis naphtha comprising pentanes and a heavy synthesis naphtha;

(c) contacting at least a portion of the heavy synthesis naphtha in a ring-cleavage zone with a nonacidic ring-cleavage catalyst, comprising at least one platinum-group metal component and a support selected from the group consisting of a nonacidic inorganic oxide, a metal-oxide solid solution and a nonacidic large-pore molecular sieve, at cleavage conditions comprising a temperature of from about 100° to 550° C., pressure of from about 100 kPa to 10 MPa, molar ratio of hydrogen to $C_5$+ hydrocarbons of about 0.01 to 100 and liquid hourly space velocity of from about 0.1 to 30 $hr^{-1}$ to convert at least about 50% of naphthenes in the heavy synthesis naphtha to yield at least about 90% of paraffins having the same carbon number as the naphthenes converted and obtain a paraffinic intermediate; and, (d) contacting the paraffinic intermediate, in combination with the heavy naphtha feedstock, with the selective isoparaffin-synthesis catalyst in the selective-isoparaffin-synthesis zone of step (a) at selective-isoparaffin conditions to obtain additional synthesis effluent.

13. The process combination of claim 12 wherein the selective isoparaffin-synthesis catalyst further comprises at least one zeolite.

14. The process combination of claim 13 wherein the zeolite comprises MOR.

15. A process combination for selectively upgrading a heavy naphtha feedstock to obtain lower-boiling hydrocarbons comprising the steps of:

(a) contacting the heavy naphtha fraction with a solid acid selective isoparaffin-synthesis catalyst comprising a zeolite in a selective-isoparaffin-synthesis zone maintained at selective-isoparaffin-synthesis conditions comprising a pressure of from about 1 MPa to 10 MPa gauge, a molar hydrogen-to-hydrocarbon ratio of from about 0.1 to 10, a liquid hourly space velocity of from about 0.5 to 20 $hr^{-1}$, and a temperature of from about 50° to 350° C. and recovering a synthesis effluent having a reduced end point relative to the heavy naphtha fraction;

(b) separating the synthesis effluent in a separation zone to obtain an isobutane concentrate amounting to at least 8.0 volume % of the heavy naphtha fraction, a light synthesis naphtha comprising pentanes and a heavy synthesis naphtha;

(c) contacting at least a portion of the heavy synthesis naphtha in a ring-cleavage zone with a nonacidic ring-cleavage catalyst, comprising at least one platinum-group metal component and a support selected from the group consisting of a nonacidic inorganic oxide, a metal-oxide solid solution and a nonacidic large-pore molecular sieve, at cleavage conditions comprising a temperature of from about 100 to 550° C., pressure of from about 100 kPa to 10 MPa and liquid hourly space velocity of from about 0.1 to 30 $hr^{-1}$ to convert at least about 50% of naphthenes in the heavy synthesis naphtha to yield at least about 90% of paraffins having the same carbon number as the naphthenes converted and obtain a paraffinic intermediate; and, (d) transferring the paraffinic intermediate from the ring-cleavage zone to the selective-isoparaffin-synthesis zone without separation of hydrogen or light hydrocarbons and contacting the intermediate, in combination with the heavy naphtha feedstock, with the selective isoparaffin-synthesis catalyst in the selective-isoparaffin-synthesis zone of step (a) at selective-isoparaffin conditions to obtain additional synthesis effluent.

* * * * *